United States Patent [19]

Kawai et al.

[11] Patent Number: 4,936,795

[45] Date of Patent: Jun. 26, 1990

[54] ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 404,627

[22] Filed: Sep. 8, 1989

[30] Foreign Application Priority Data

Oct. 4, 1988 [JP] Japan ..... 63-249149

[51] Int. Cl.[5] ..... H01R 13/648

[52] U.S. Cl. ..... 439/609; 439/95; 439/607

[58] Field of Search ..... 439/607-610, 439/92, 95, 108, 668

[56] References Cited

U.S. PATENT DOCUMENTS

| | | | |
|---|---|---|---|
| 4,568,133 | 2/1986 | Amano et al. | 439/607 X |
| 4,637,669 | 1/1987 | Tajima | 439/609 X |
| 4,842,554 | 6/1989 | Cosmos et al. | 439/609 |
| 4,842,555 | 6/1989 | Cosmos et al. | 439/609 |

FOREIGN PATENT DOCUMENTS 61-184285 11/1986 Japan .

*Primary Examiner*—Steven C. Bishop
*Attorney, Agent, or Firm*—Kanesaka & Takeuchi

[57] ABSTRACT

An electrical connector includes an insulating housing having an annular recess extending rearwardly from a front end thereof and a shield member having a cylindrical wall fitted into the annular recess, a plurality of contact lugs extending outwardly in radial directions from a front edge thereof, and a leg member for connection with a shield circuit of a printed circuit board. The shield member has a plurality of first cantilever contacts bent outwardly and then inwardly forming an outward projection for contact with a metal shield provided on an inside of a mating shell member and a plurality of second cantilever contacts bent inwardly and then outwardly forming an inward projection for contact with a metal shield provided on an outside of the mating shell member.

6 Claims, 3 Drawing Sheets

ELECTRICAL CONNECTOR

BACKGROUND OF THE INVENTION

The present invention relates to shielded electrical connectors.

Japanese U.M. Patent Application Kokai No. 61-184,285 discloses such an electrical connector which includes an insulating housing having an annular recess extending rearwardly from the front end for receiving the shell member of a mating connector. A shield member fitted in the annular recess has cantilever contact members with a spring free end for contact with a metal shield provided on the inside of the mating shell member and a leg member extending through the rear slit of the insulating housing for attachment to a printed circuit board.

With the above electrical connector, however, it is impossible to make a shield connection when the metal shield is provided on the outside of a mating shell member. In addition, the metal from which the cantilever contacts and the shield member are formed is so thin that the contacts are liable to deformation upon plugging in or out of the mating connector. Moreover, the materials of the insulating housing and the shield member are so weak that the mating end of the insulating housing and the front end of the shield member are liable to damage upon plugging in or by an impact applied from the outside.

SUMMARY OF THE INVENTION

Accordingly, it is an object of the present invention to provide an electrical connector which is able to make a shield connection with a mating connector no matter whether the metal shield is provided on the inside or outside of the mating shell member.

It is another object of the invention to provide an electrical connector having contact members which are free of deformation by an excess load which can be applied upon plugging in or out.

According to the invention, the above object is achieved by an electrical connector which include an insulating housing having an annular recess extending rearwardly from a front end thereof; a shield member having a cylindrical wall fitted into the annular recess, a plurality of cantilever contacts on either side thereof having a spring free end for contact with a metal shield provided on a shell member of a mating connector, and a leg member for connection with a shield circuit of a printed circuit board; and an end face protection member made from a metal sheet to cover the front end of the insulating housing.

According to the invention, the cantilever contacts on either side are able to make a shield contact with the metal shield which is provided on either the inside or outside of a mating shell member. The free end bent away from the mating shell member permits easy insertion of the mating shell member. The central opening of the end face protection member restricts radial movement of the mating shell member so that cantilever contacts are protected from deformation by excessive load which can be applied upon plugging in or out of the mating connector.

Other objects, features, and advantages of the invention will be apparent from the following description when taken in conjunction with the accompanying drawings.

DESCRIPTION OF THE PREFERRED EMBODIMENT

Figure 1:
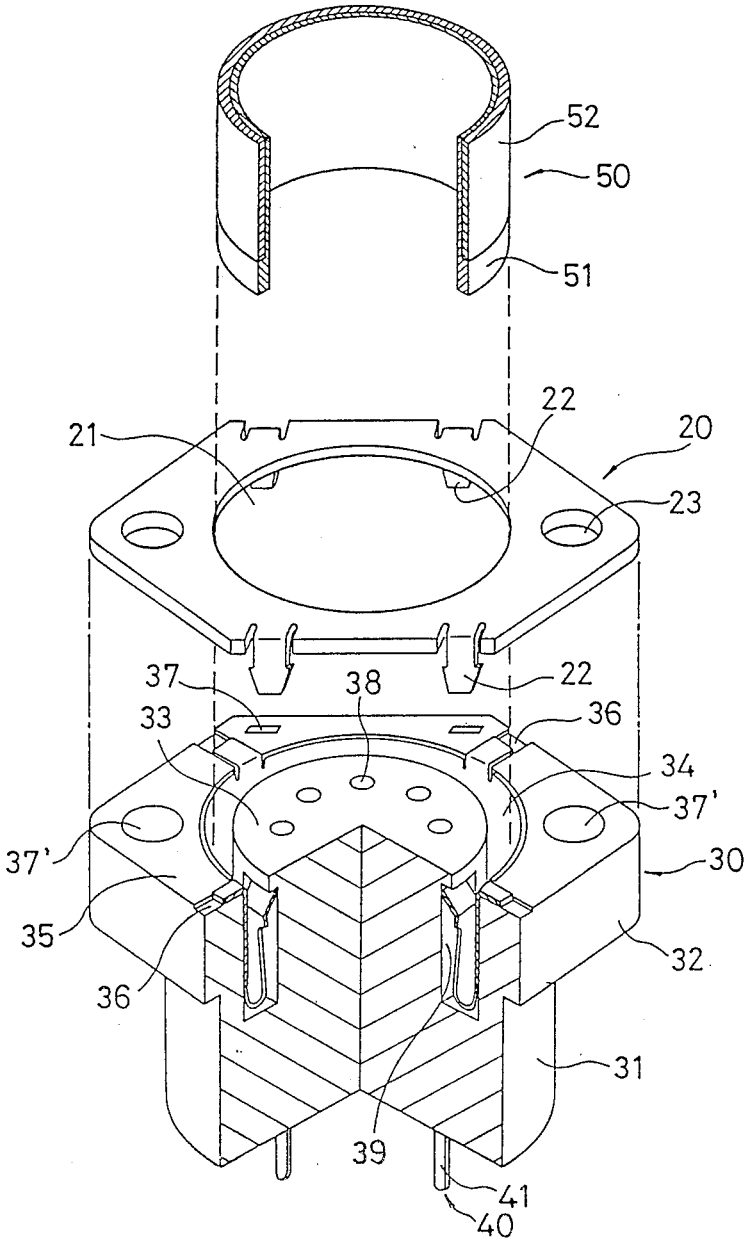
FIG. 1 is a partially cutaway, exploded perspective view of an electrical connector according to an embodiment of the invention.

FIG. 1 shows an electrical connector which includes a shield member 10 (FIG. 2), an end face protection member 20, an insulating housing 30, and contacts 40.

Figure 2:
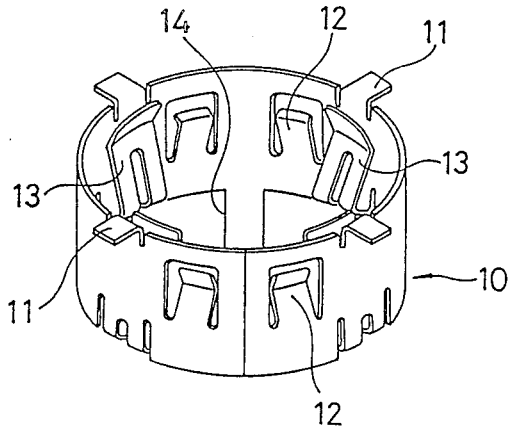
FIG. 2 is a perspective view of a shield member useful for the electrical connector of FIG. 1.

As best shown in FIG. 2, the shield member 10 is made by stamping and forming a spring metal thin sheet in the form of a cylinder. A plurality of contact lugs 11 extending outwardly in radial directions from the front edge of the shield member 10 for engagement with radial grooves 36 which are provided on the front surface 35 of a front section 32 of the insulating housing 30. A plurality of cantilever contacts 12 are provided on the circumferential surface for contact with the metal shield of a mating connector. This cantilever contact is made by punching out substantially C-shaped pieces and bending inwardly and then outwardly. A plurality of cantilever contacts 13 are bent by slightly more than 180 degrees so that it extends first slightly outwardly and then inwardly for engagement with the insulating housing with the tip and the metal shield of a mating connector with the inwardly projected portion. A leg member 14 extends downwardly for connection to a grounding circuit (not shown).

As best shown in FIG. 1, the end face protection member 20 is made by stamping and forming a relatively thick metal sheet. It has a central opening 31 with a diameter substantially equal to the shell member 50 of a mating connector for receiving it and a substantially hexagonal shape which is substantially identical with the front end of the insulating housing 30. Two pairs of lance members 22 extend downwardly from opposite two sides of the end face protection member 20 for insertion into latch slots 37. These lance members are made so that the end face protection member 20 is detachable from the insulating housing by means of a simple extracting tool. A pair of through holes 23 are provided for receiving attaching bolts (not shown).

The insulating housing 30 is molded from a dielectric plastic so as to have a cylindrical body 31, a hexagonal front section 32, and a cylindrical contact support section 33 which extends upwardly from the cylindrical body 31 so as to define an annular recess 34 in which the shield member 10 and the mating shell member 50 are fitted. A plurality of radial grooves 36 are provided on the front surface of the front section 32 corresponding to the contact lugs 11. A plurality of latch slots 37 are provided on the front section 32 for engagement with latch lances 22. A pair of through holes 37' are provided for receiving attaching bolts. A plurality of contact holes 38 are provided on the contact support section 33 to support contacts. A plurality of latch channels 39 are provided on the circumferential surface of the contact support section 33 for engagement with the tips of the latch contacts 13.

The contact 40 has a contact portion (not shown) for contact with the contact of a mating connector within the insulating housing and a connection portion 41 which projects from the bottom of the insulating housing for connection to the electrical circuit of a printed circuit board (not shown).

The shield member 10 and the end face protection member 20 are assembled into the insulating housing 30 as follows.

(1) The shield member 10 as shown in FIG. 2 is inserted into the annular recess 34 of the insulating housing 30 so that the latch contacts 13 and the contact lugs 11 fit in the latch channels 39 and the radial grooves 36 respectively. Preferably, each lug 11 has a spring tip projecting beyond the front surface 35 for better electrical connection to the backside of the protection member 20.

(2) The end face protection member 20 is then mounted on the front end 35 such that the latch lances 22 fit into the latch slots 37 for integration by latching. Consequently, the backside of the protection member 20 comes into electrical contact with the contact lugs 11. Thus, the electrical connector is shielded in part of the front and the entire side. In addition, when a mating connector is plugged in, the end face protection member comes into contact with the finger so that the static electricity is discharged, thus preventing the circuitry from malfunctioning.

(3) When the shell member 50 of a mating connector is plugged in the electrical connector, the shell member 50 is guided by the central opening 21 of the tick protection member 20 so that no excessive forces are applied to the cantilever contacts 12 and the cantilever latch contacts 13, thus preventing inadvertent damage thereto. Hence, when a metal shield 52 is provided on the outside of the shell member 50, the metal shield 52 contacts the cantilever contacts 12 while when it is provided on the inside of the shell member 50, the metal shield 52 contacts the cantilever latch contacts 13.

With the shield member 10 and the end face protection member 20 thus considered, not only it is possible to always make an electrical connection between these members but also it is easy to replace the protection member 20 on the front end 35 of the insulating housing 30 according to the type of application.

Alternatively, the shield member, which is stamped and formed from a metal sheet, may be made by assembling two or more shield sections to form a cylindrical shield member.

Figure 3:
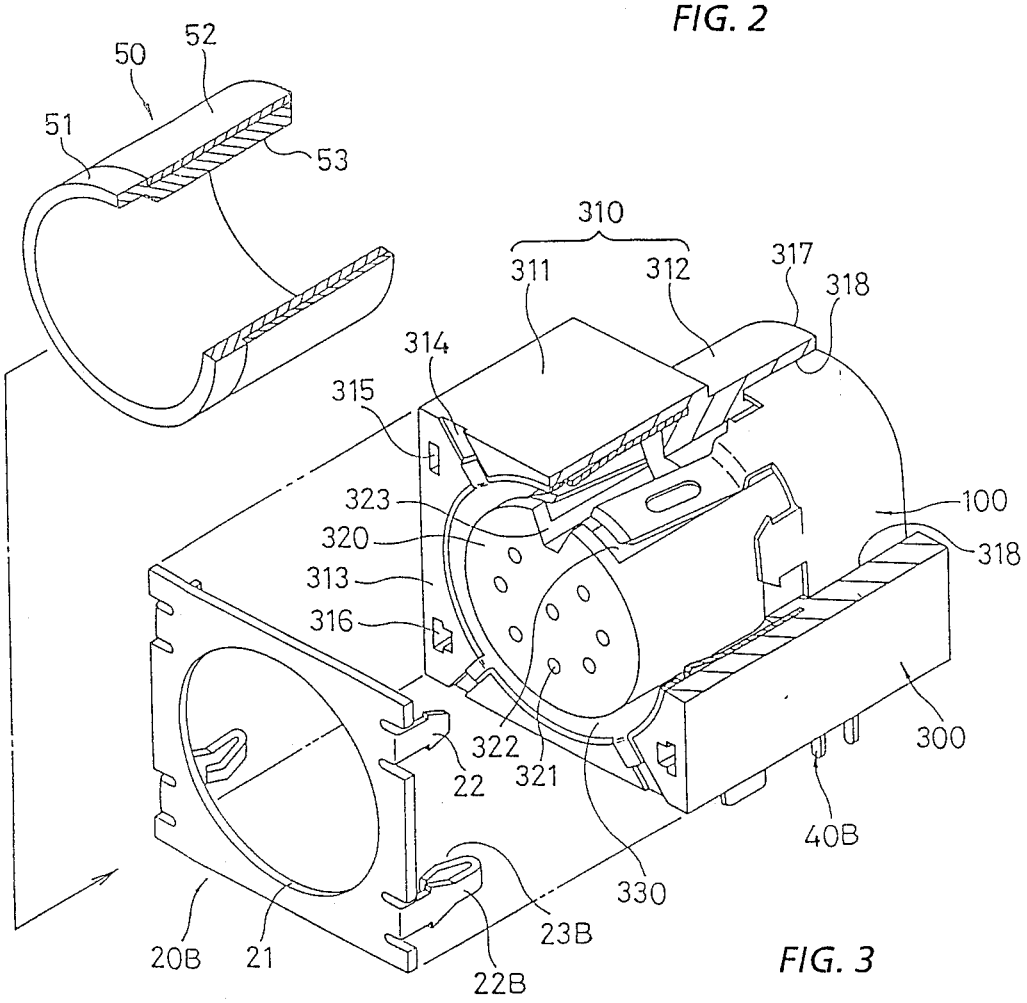
FIG. 3 is a partially cutaway, exploded perspective view of an electrical connector according to another embodiment of the invention.
Figure 4:
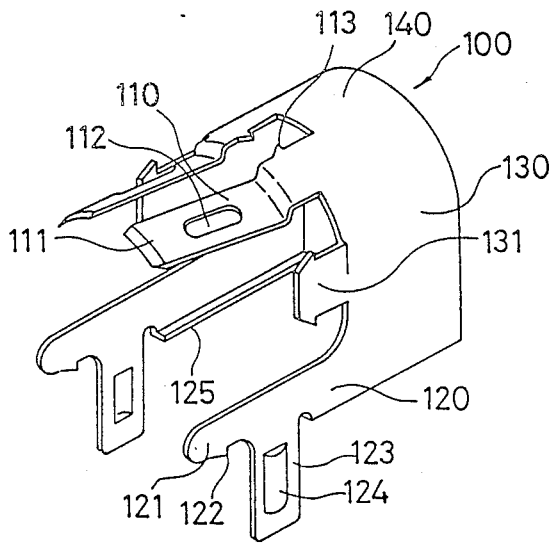
FIG. 4 is a perspective view of a metal hood useful for the electrical connector of FIG. 3.
Figure 5:
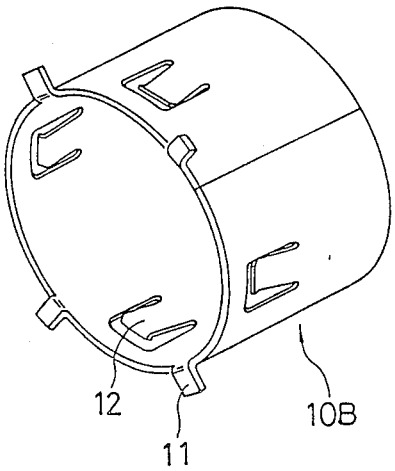
FIG. 5 is a perspective view of a shield member useful for the electrical connector of FIG. 3.

FIGS. 3–5 show an electrical connector according to another embodiment of the invention, in which a mating connector is plugged in a direction parallel to the printed circuit board. This electrical connector includes a shield member 10B, a metal hood member 100, an end face protection member 20B, an insulating housing 300, and contacts 40B.

As best shown in FIG. 5, the shield member 10B is identical with the shield member 10 of FIG. 2 except for lack of the latch contacts 13 and the leg member 14.

The metal hood member 100 is made by stamping and forming a spring metal sheet so as to have a pair of contact members 110 and a pair of attaching members 120 for securing the insulating housing 30 to a printed circuit board (not shown). The contact member 110 is bent so as to have an L-shaped longitudinal section with a free end 111 for contact with the metal shield provided on the inside of the shell member of a mating connector. A slot 112 is provided in the finger member 110 in order to improve the spring property. A projection 113 is provided on the rear inner side of the contact member 110 to engage with the insulating housing thereby preventing the hood member 100 from falling off from the insulating housing 300.

A latch lance 131 is provided on the front edge of an intermediate section 130, which connects the contact member 110 and the attaching member 120, to be pushed into a latch slot (not shown) on the rear section of the insulating housing. The attaching section 120 has a contact end 121 to be inserted into a latch slot of the insulating housing 300 for contact with the contact section 23B of the latch lance 22B of an end face protection member 20B and a projection 122 for preventing the hood member from falling off from the insulating housing.

A leg member 123 extends downwardly from the attaching section 120 for insertion into the attaching slot of a printed circuit board and has a projection 124 for engagement with the inside wall of the attaching slot. This leg member 123 is soldered to the grounding circuit of the PCB. A flange 125 extends inwardly from the lower edge of each attaching member 120 for supporting the rear section of the insulating housing 300. A top portion 140 of the hood member 100 connects a pair of the intermediate sections 130 to form a U-shaped rear section as a whole.

The end face protection member 20B has a square shape substantially identical with that of the front end of the insulating housing 300. A lower latch lance 22B has a contact member 23B for contact with a free end 121 of the attaching member 120 of the metal hood 100 for shielding. The other portions are identical with those of the end face protection member 20.

The insulating housing 300 has a contact support portion 320 within the body portion 310 and an annular recess 330 defined between them. The body portion 310 has a cubic front section 311 and a U-shaped rear section 312. The front section 311 has on the front end 313 radial recesses 314 corresponding to the contact lugs 11 of the shield member 10B and a pair of latch slots 315 for receiving the upper latch lances 22 for latch. Also, it has a pair of T-shaped latch slots 316 for receiving the lower latch lances 22B and contact members 23B. The latch slots communicate with attaching recesses (not shown) so that the free ends 121 come to contact with the contact members 23B.

The rear section 312 has a U-shaped slot 318 extending toward the front from the rear end 317 for receiving the rear portion of the U-shaped metal hood 100. The slot 318 communicate with fixing recess into which latch lances are to be pushed and fixing slots for receiving the free end 121 of the metal hood 100.

The contact support portion 320 has a plurality of apertures 321 therein for supporting L-shaped contacts 40B and channels 322 on the circumferential surface for receiving contact members 110 of the metal hood 100. The channels communicate with the U-shaped recess 318. A guide groove 323 is provided so as to receive a correspond guide key 53 provided on the inside of the shell member of a mating connector. Like the above embodiment, the annular recess 330 receives the shield member 10B and the shell member 50 of a mating connector.

With the electrical connector according to the invention, it is possible to make shield connection even if the metal shield of a mating connector is provided on the inside or outside of the shell member. In addition, the end face protection member make it possible to minimize the gap between the end face protection member and the shell member of a mating connector. Moreover, since the mating end of the insulating housing and front end of the shield member are completely protected, there is no or little danger that the contacts are deformed or the mating end of the insulating housing and the front end of the shield member are damaged upon plugging in or out of a mating connector.

We claim:

1. An electrical connector comprising:

an insulating housing having an annular recess extending rearwardly from a front end thereof; and a shield member having a cylindrical wall fitted into said annular recess, a plurality of contact lugs extending outwardly in radial directions from a front edge thereof, and a leg member for connection with a shield circuit of a printed circuit board;

said shield member having a plurality of first cantilever contacts bent outwardly and then inwardly forming an outward projection for contact with a metal shield provided on an inside of a mating shell member and a plurality of second cantilever contacts bent inwardly and then outwardly forming an inward projection for contact with a metal shield provided on an outside of said mating shell member.

2. The electrical connector of claim 1, which further comprises an end face protection member which is made from a metal sheet thicker than that of said sheld member to cover said front end of said insulating housing coming into contact with said contact lugs to shield front and side portions of said electrical connector and has a central opening for guiding said mating shell member upon plugging in or out.

3. The electrical connector of claim 2, wherein said end face protection member has a plurality of latch lances for engagement with latch slots provided on a front portion of said insulating housing to make said end face protection member detachable by means of a simple extracting tool.

4. An electrical connector comprising:

an insulating housing having an annular recess extending rearwardly from a front end thereof and a U-shaped recess extending forwardly from a rear end thereof;

a U-shaped hood member which is inserted into said U-shaped recess and has a plurality of attaching members with a free contact end and a plurality of first cantilever contacts for contact with a metal shield provided on an inside of a mating shell member; and a shield member having a cylindrical wall fitted into said annular recess and a plurality of contact lugs extending outwardly in radial directions from a front edge thereof, said shield member having a plurality of second cantilever contacts bent inwardly and then outwardly forming an inward projection for contact with a metal shield provided on an outside of said mating shell member.

5. The electrical connector of claim 4, which further comprises an end face protection member to cover a front end of said insulating housing coming into contact with said contact lugs thereby shielding part of front and side portions of said electrical connector.

6. The electrical connector of claim 5, wherein said end face protection member has a plurality of first latch lances for engagement with a plurality of latch slots on a front end of said insulating housing and a plurality of second latch lances each having a contact member for contact with said free contact end.

* * * * *